US010252535B2

(12) United States Patent
Kobayashi

(10) Patent No.: US 10,252,535 B2
(45) Date of Patent: Apr. 9, 2019

(54) INK TANK AND INKJET PRINTER

(71) Applicant: MIMAKI ENGINEERING CO., LTD., Nagano (JP)

(72) Inventor: Hiroshi Kobayashi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 9 days.

(21) Appl. No.: 15/682,552

(22) Filed: Aug. 22, 2017

(65) Prior Publication Data

US 2018/0056658 A1 Mar. 1, 2018

(30) Foreign Application Priority Data

Aug. 24, 2016 (JP) ..... 2016-163830

(51) Int. Cl.
*B41J 2/175* (2006.01)
*B41J 2/19* (2006.01)
*B41J 2/18* (2006.01)

(52) U.S. Cl.
CPC ..... *B41J 2/17513* (2013.01); *B41J 2/18* (2013.01); *B41J 2/17566* (2013.01); *B41J 2/17596* (2013.01)

(58) Field of Classification Search
CPC ..... B41J 2/17556; B41J 2/19; B41J 2/17513; B41J 2/18; B41J 2/17596
See application file for complete search history.

(56) References Cited

U.S. PATENT DOCUMENTS

2010/0045757 A1* 2/2010 Ito ..... B41J 2/17556 347/92

FOREIGN PATENT DOCUMENTS

JP 2010-076393 4/2010

* cited by examiner

*Primary Examiner* — Jason S Uhlenhake
(74) *Attorney, Agent, or Firm* — JCIPRNET

(57) ABSTRACT

A sub tank (40) which is mounted in an inkjet printer including an inkjet head for discharging UV ink and supplies UV ink to the inkjet head includes a space forming unit (41) which forms a space (40*a*) including an ink storage chamber (40*b*) for storing UV ink and a pump communication port communicating with a pump for making a pressure in the space (40*a*) negative, and a liquid-proof ventilation filter (44) which is disposed in the space (40*a*), allows gas to be circulated, and does not allow the UV ink to be circulated so as to prevent the UV ink from flowing out from the space (40*a*) to the pump communication port.

9 Claims, 16 Drawing Sheets

INK TANK AND INKJET PRINTER

CROSS REFERENCE TO RELATED APPLICATIONS

This application claims the priority benefit of Japanese Patent Application No. 2016-163830, filed on Aug. 24, 2016. The entirety of the above-mentioned patent application is hereby incorporated by reference herein and made a part of this specification.

TECHNICAL FIELD

The disclosure relates to an ink tank and an inkjet printer for an inkjet printer which executes printing by discharging ink toward a medium on which printing is executed and an inkjet printer.

DESCRIPTION OF THE BACKGROUND ART

An inkjet printer including an inkjet head for discharging ink, an ink tank for supplying ink to the inkjet head, and a pump is known (for example, see Japanese Unexamined Patent Application Publication No. 2010-076393).

In Japanese Unexamined Patent Application Publication No. 2010-076393, the ink tank includes a space forming unit which forms a space including an ink storage chamber for storing ink and a pump communication port communicating with the pump. Here, when the space in the ink tank has a positive pressure, ink cannot be held in a nozzle of the inkjet head, and the ink disadvantageously flows down from the nozzle. Therefore, the pump makes a pressure in the space in the ink tank negative.

When the pump makes the pressure in the space in the ink tank negative, gas is sucked from the space in the ink tank to the pump side. However, ink in the ink storage chamber may also be sucked to the pump side together with the gas.

Therefore, in the technique described in Japanese Unexamined Patent Application Publication No. 2010-076393, a backflow blocking mechanism which prevents the ink sucked by the pump from the space in the ink tank from reaching the pump is disposed between the ink tank and the pump.

SUMMARY

However, in the inkjet printer described in Japanese Unexamined Patent Application Publication No. 2010-076393, since a backflow blocking mechanism needs to be included independently of the ink tank, the inkjet printer disadvantageously becomes large.

Accordingly, the disclosure provides an ink tank and an inkjet printer each of which can make a structure for making a pressure in a space in the ink tank negative smaller than that of a conventional ink tank or a conventional inkjet printer.

The ink tank of the disclosure is an ink tank which is mounted in an inkjet printer having an inkjet head for discharging ink and supplies ink to the inkjet head, and includes: a space forming unit which forms a space including an ink storage chamber for storing ink and a pump communication port communicating with a pump for making a pressure in the space negative; and a liquid-proof ventilation filter which is disposed in the space, allows gas to be circulated, and does not allow the ink to be circulated so as to prevent the ink from flowing out from the space to the pump communication port.

With this configuration, in the ink tank of the disclosure, since the liquid-proof ventilation filter for preventing an outflow of ink from the space in the ink tank to the pump side is disposed in the space in the ink tank, a configuration for preventing the outflow of ink from the space in the ink tank to the pump side need not be disposed independently of the ink tank. Therefore, in the ink tank of the disclosure, the structure for making the pressure in the space in the ink tank negative can be made smaller than that in a conventional ink tank.

In the ink tank of the disclosure, the space forming unit includes a bubble circulation interruption portion which narrows a flow path of gas between the ink storage chamber and the liquid-proof ventilation filter to interrupt circulation of bubbles of ink from the ink storage chamber side to the liquid-proof ventilation filter side, and the bubble circulation interruption portion may be disposed on an upper side of the upper limit of an ink liquid level set in the ink storage chamber in a vertical direction when the ink tank is mounted in the inkjet printer.

The performance of the liquid-proof ventilation filter which circulates gas to prevent ink from being circulated is deteriorated when the ink is brought into contact with the liquid-proof ventilation filter to pool the ink on the surface of the liquid-proof ventilation filter. In the ink tank of the disclosure, even though bubbles are generated in the ink in the ink storage chamber, since the bubble circulation interruption portion can interrupt reaching of the bubbles of ink to the liquid-proof ventilation filter, a period for which the performance of the liquid-proof ventilation filter is maintained can be elongated.

In the ink tank of the disclosure, when the ink flowing from the space side to the pump communication port side comes in contact with the liquid-proof ventilation filter and is pooled on a surface, in the liquid-proof ventilation filter, the ink can be removed from the surface by the gas flowing from the pump communication port side to the space side. The liquid-proof ventilation filter may be disposed at a position through which the gas fed from the pump communication port to the space passes when a positive pressure is applied from the pump communication port to the space.

With this configuration, even though the ink comes in contact with the liquid-proof ventilation filter and the ink pools on the surface of the liquid-proof ventilation filter, the positive pressure is applied from the pump communication port to the space in the ink tank to make it possible to remove the ink pooled on the surface of the liquid-proof ventilation filter from the surface of the liquid-proof ventilation filter. Thus, the liquid-proof ventilation filter can be easily restored.

In the ink tank of the disclosure, in the space forming unit, an ink supply port to which ink is supplied from a main tank included in the inkjet printer and a supply flow path serving as a flow path extending from the ink supply port to the ink storage chamber are formed. When the ink tank is mounted in the inkjet printer, the supply flow path may communicate with the ink storage chamber on a lower side of the lower limit of an ink liquid level set in the ink storage chamber in the vertical direction.

With this configuration, when the ink tank of the disclosure is mounted in the inkjet printer, a flow path for supplying ink from the main tank to the ink storage chamber communicate with the ink storage chamber on the lower side of the lower limit of the ink liquid level set in the ink storage chamber in the vertical direction. Thus, bubbles of ink generated by supplying ink from the main tank can be prevented from being generated in the ink storage chamber.

Therefore, since the ink tank of the disclosure can inhibit the bubbles of ink from reaching the liquid-proof ventilation filter, a period for which the performance of the liquid-proof ventilation filter is maintained can be elongated.

An inkjet printer of the disclosure includes an inkjet head for discharging ink, an ink tank for supplying ink to the inkjet head, and a pump. The ink tank includes a space forming unit which forms a space including an ink storage chamber for storing ink and a pump communication port communicating with the pump and a liquid-proof ventilation filter which is disposed in the space, allows gas to be circulated, and does not allow the ink to be circulated so as to prevent the ink from flowing out from the space to the pump communication port.

With this configuration, in the inkjet printer of the disclosure, since the liquid-proof ventilation filter for preventing the ink from flowing out from the space in the ink tank to the pump side is disposed in the space in the ink tank, a configuration for preventing the ink from flowing out from the space in the ink tank to the pump side need not be disposed independently of the ink tank. Therefore, in the inkjet printer of the disclosure, the structure for making a pressure in the space in the ink tank negative can be reduced in size.

In the ink tank and the inkjet printer of the disclosure, the structure for making the pressure in the space in the ink tank negative can be made smaller than that in a conventional ink tank.

DETAILED DESCRIPTION OF EMBODIMENT

Hereinafter, an embodiment of the disclosure will be described with reference to the drawings.

First, a configuration of an inkjet printer according to the embodiment will be described.

Figure 1:
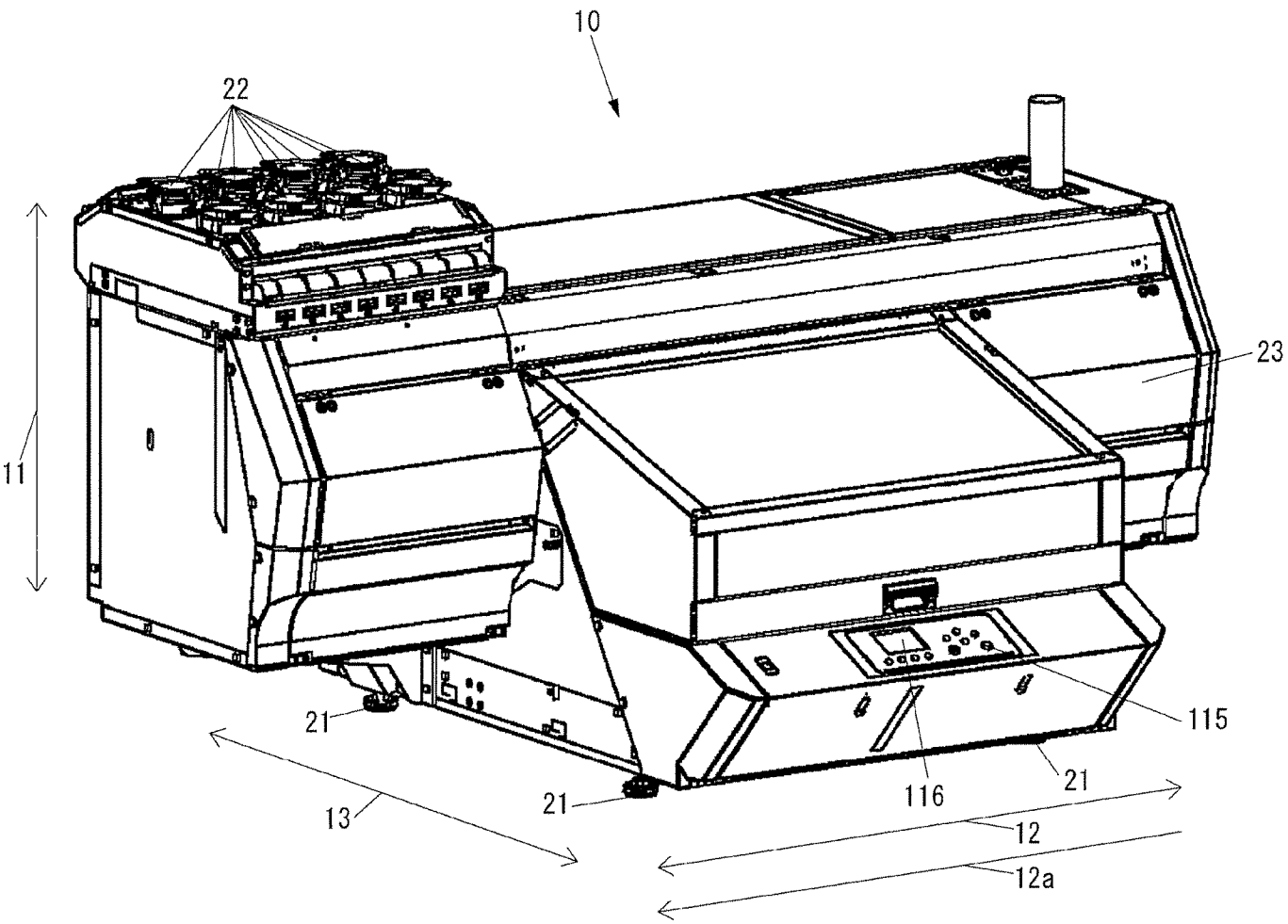
FIG. 1 is an external perspective view of an inkjet printer according to an embodiment of the disclosure when being observed from an upper left front side.

FIG. 1 is an external perspective view of an inkjet printer 10 according to the embodiment when being observed from the front left upper side.

As shown in FIG. 1, an inkjet printer 10 houses legs 21 placed on a floor, a plurality of bottles 22 storing ultraviolet curing type ink (to be referred to as "UV ink" hereinafter) serving as ink to be cured by irradiation of ultraviolet rays, and a front cover 23 that covers the front face of the inkjet printer 10.

As the UV ink, PR 200 available from Mimaki Engineering Co., Ltd., for example, can be employed.

Figure 2:
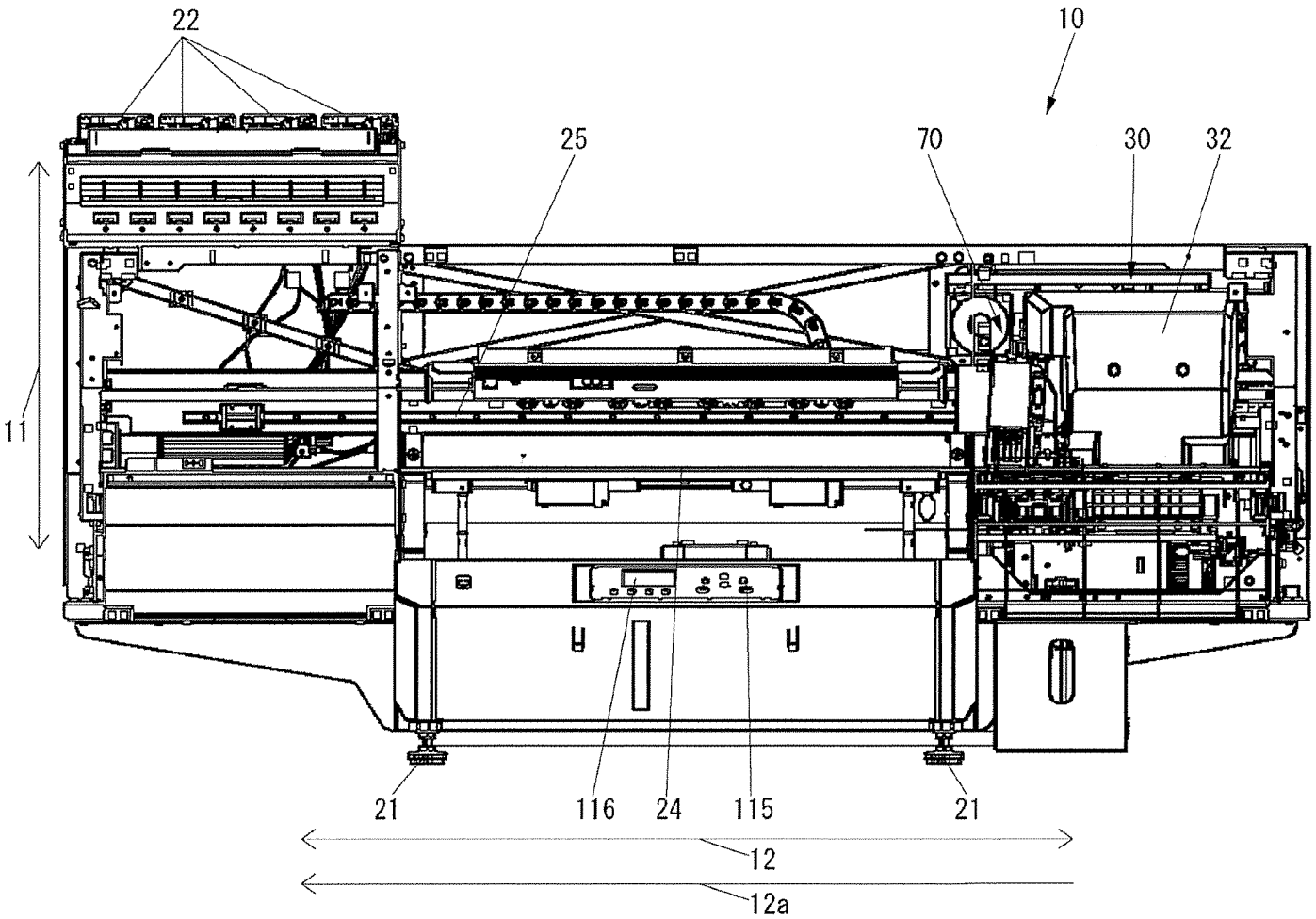
FIG. 2 is a front view of the inkjet printer shown in FIG. 1 in a state in which a front cover is removed.

FIG. 2 is a front view of the inkjet printer 10 with the front cover 23 removed.

As shown in FIG. 2, the inkjet printer 10 includes a table 24 extending in perpendicular directions perpendicular to the vertical direction indicated by an arrow 11 and supporting a medium on which printing is executed, a guide rail 25 extending in a main scanning direction indicated by an arrow 12 indicating the horizontal direction of the inkjet printer 10 of the perpendicular directions perpendicular to the vertical direction indicated by the arrow 11, and a head unit 30 which can be moved in the main scanning direction indicated by the arrow 12 while being supported by the guide rail 25 and is relatively moved with respect to the table 24.

As a medium on which printing is executed, various objects such as a case for a smartphone and a notebook can be employed.

Figure 3:
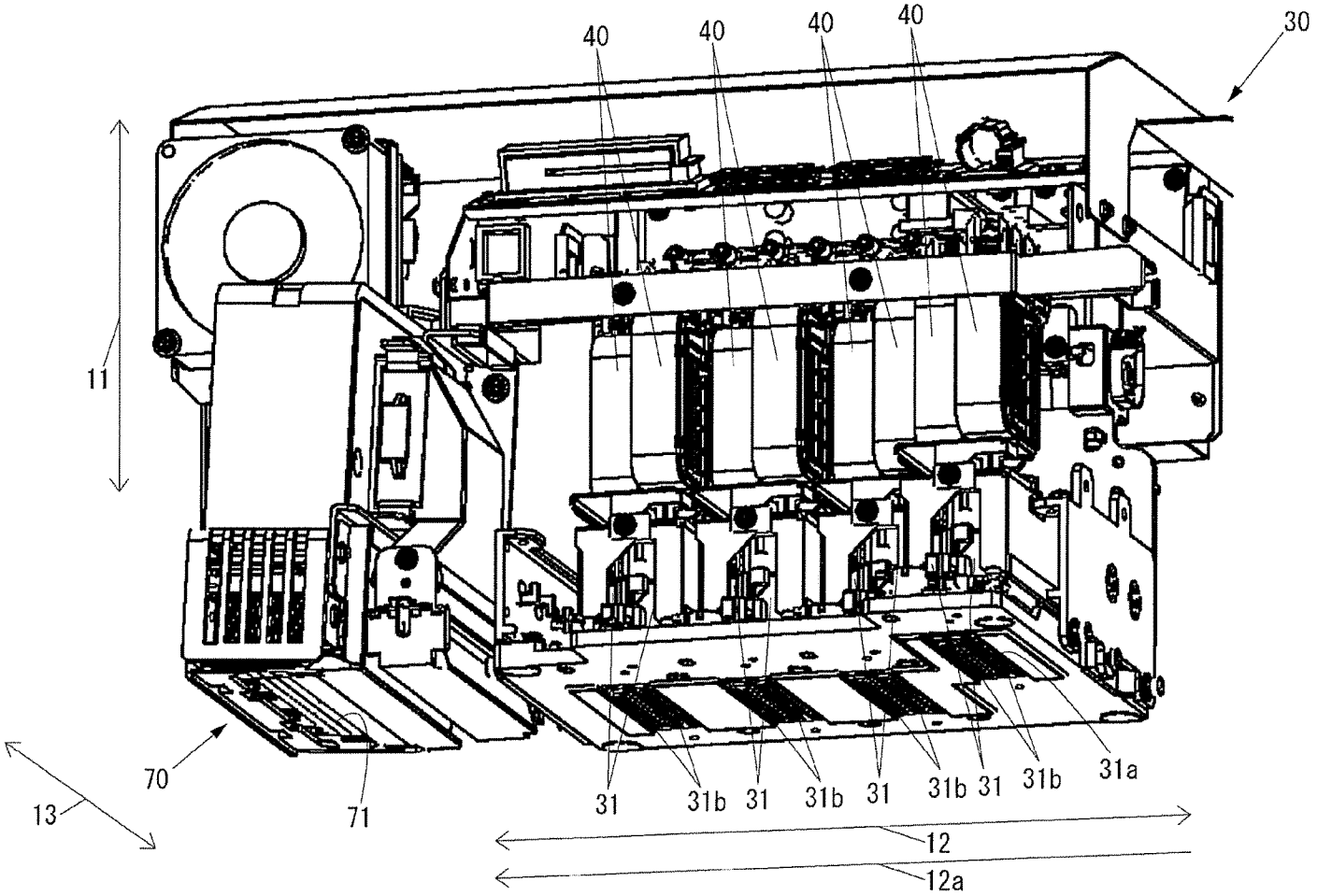
FIG. 3 is an external perspective view of a head unit shown in FIG. 2 in a state where the cover is removed when being observed from the lower right side of the head unit.
Figure 4:
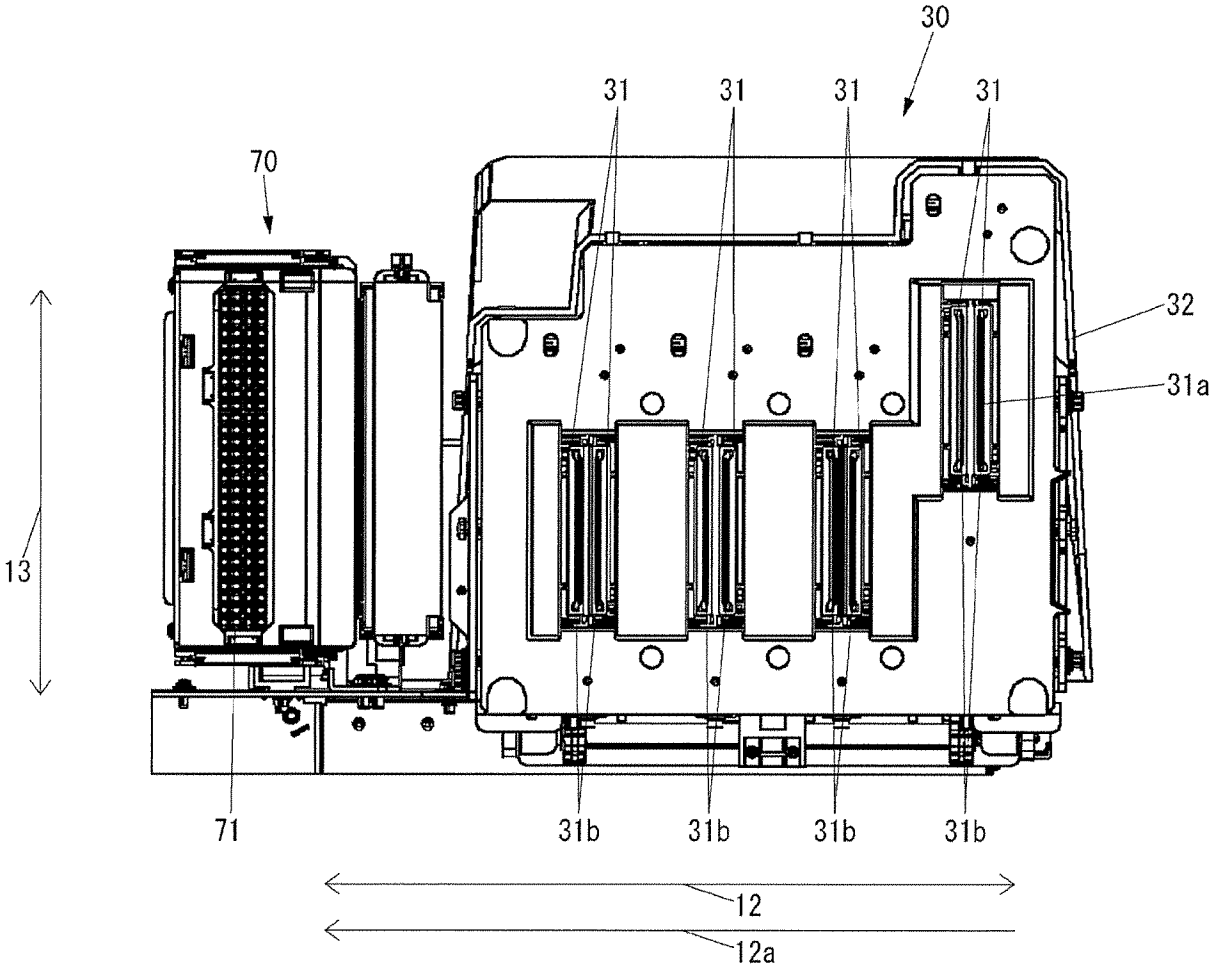
FIG. 4 is a bottom view of the head unit shown in FIG. 2.

FIG. 3 is an external perspective view of the head unit 30 in a state in which the cover 23 is removed when being viewed from the front lower right side of the head unit 30. FIG. 4 is a bottom view of the head unit 30.

As shown in FIGS. 3 and 4, the head unit 30 includes a plurality of inkjet heads 31 for discharging UV ink toward a medium on which printing is executed supported on the table 24 (see FIG. 2), sub tanks 40 serving as ink tanks supplying the UV ink to the inkjet heads 31, a cover 32 covering the front surfaces of the plurality of inkjet heads 31, the front surfaces of the plurality of sub tanks 40, and the upper surfaces of the plurality of sub tanks 40, and a UV unit 70 for radiating ultraviolet rays towards the UV ink on the medium on which printing is executed supported on the table 24.

In the inkjet heads 31, a nozzle row 31*b* in which a plurality of nozzles 31*a* for discharging UV ink are arrayed is formed. The nozzle row 31*b* extends in the sub scanning directions indicated by an arrow 13 which are the forward and backward directions of the inkjet printer 10 of the perpendicular directions perpendicular to the vertical direction indicated by the arrow 11.

For example, the colors of UV inks discharged from the inkjet heads 31 are, for example, yellow, magenta, cyan, black, light cyan, light magenta, white, and clear in this order from the inkjet head 31 at the left end to the inkjet head 31 at the right end in FIG. 4.

The UV unit 70 includes an LED (Light Emitting Diode) 71 for radiating ultraviolet rays toward the UV ink on the medium on which printing is executed supported on the table 24. The LED 71 is present in the inkjet head 31 in a direction indicated by an arrow 12*a* of the main scanning directions indicated by the arrow 12.

Figure 5:
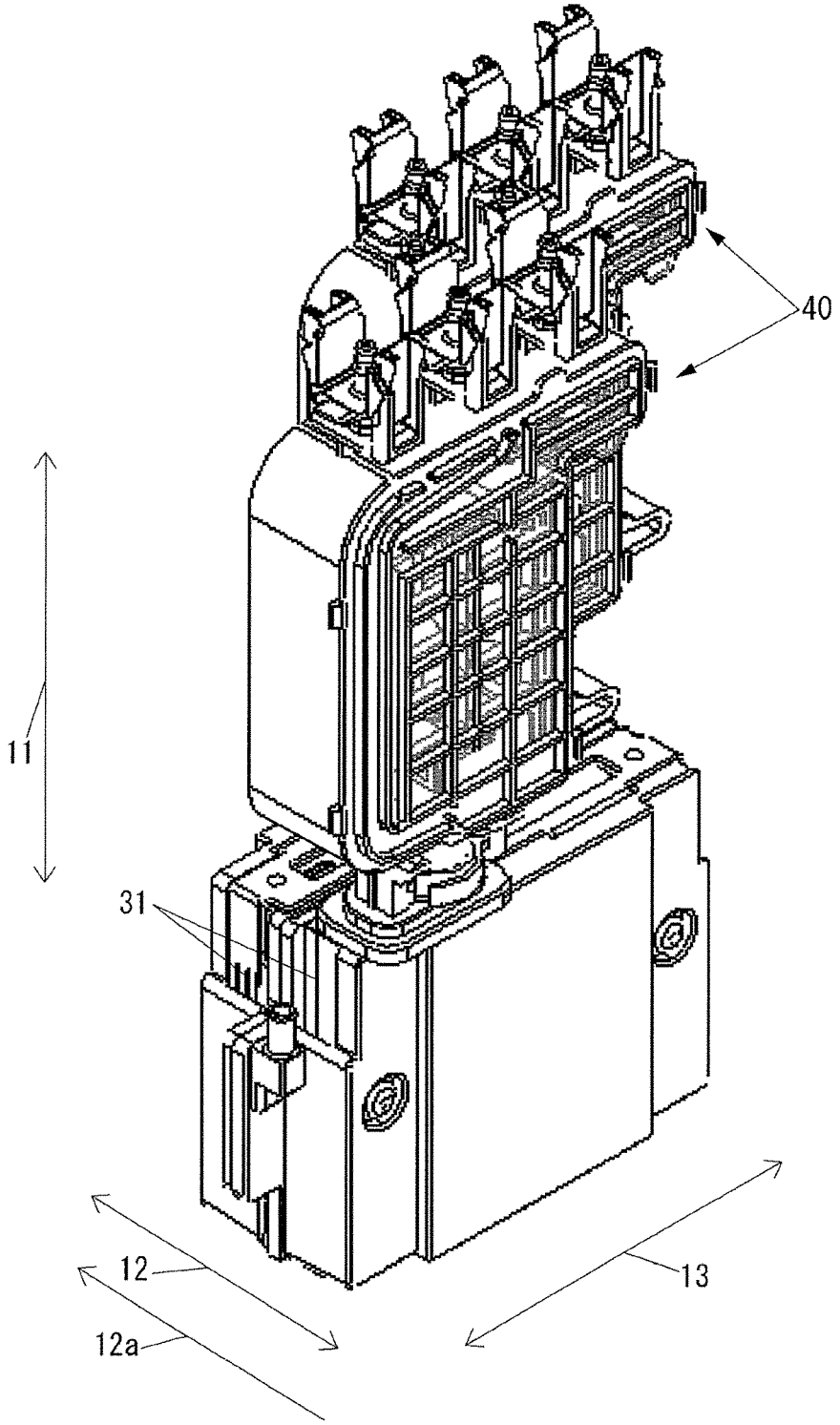
FIG. 5 is an external perspective view of a unit constituted by two inkjet heads and two sub tanks shown in FIG. 3.
Figure 6:
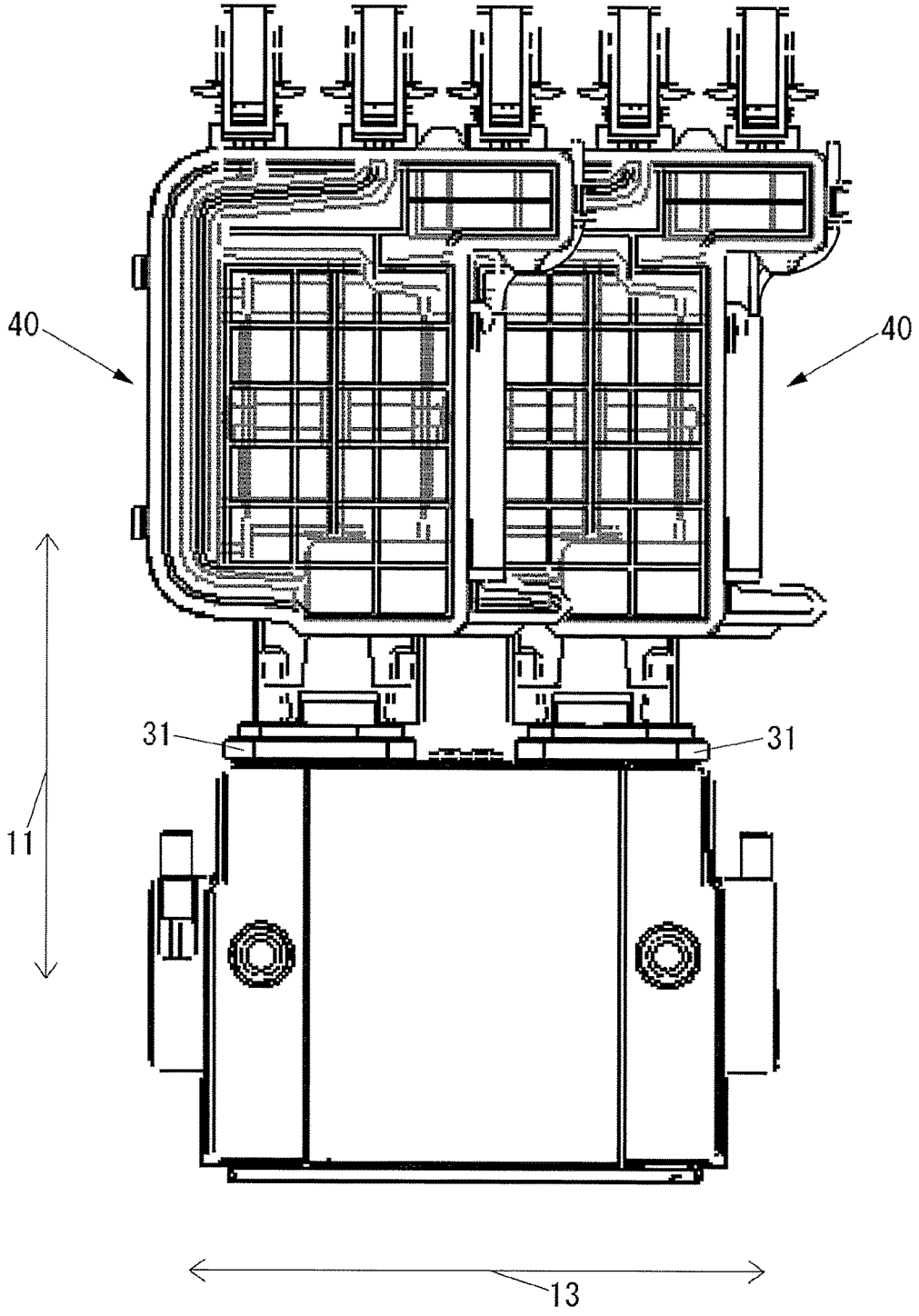
FIG. 6 is a side view of the unit shown in FIG. 5.

FIG. 5 is an external perspective view of a unit constituted by the two inkjet heads 31 and the two sub tanks 40. FIG. 6 is a side view of the unit shown in FIG. 5.

As shown in FIGS. 5 and 6, every two inkjet heads 31 are unitized. In addition, each of the sub tanks 40 is connected to each of the inkjet heads 31.

Figure 7:
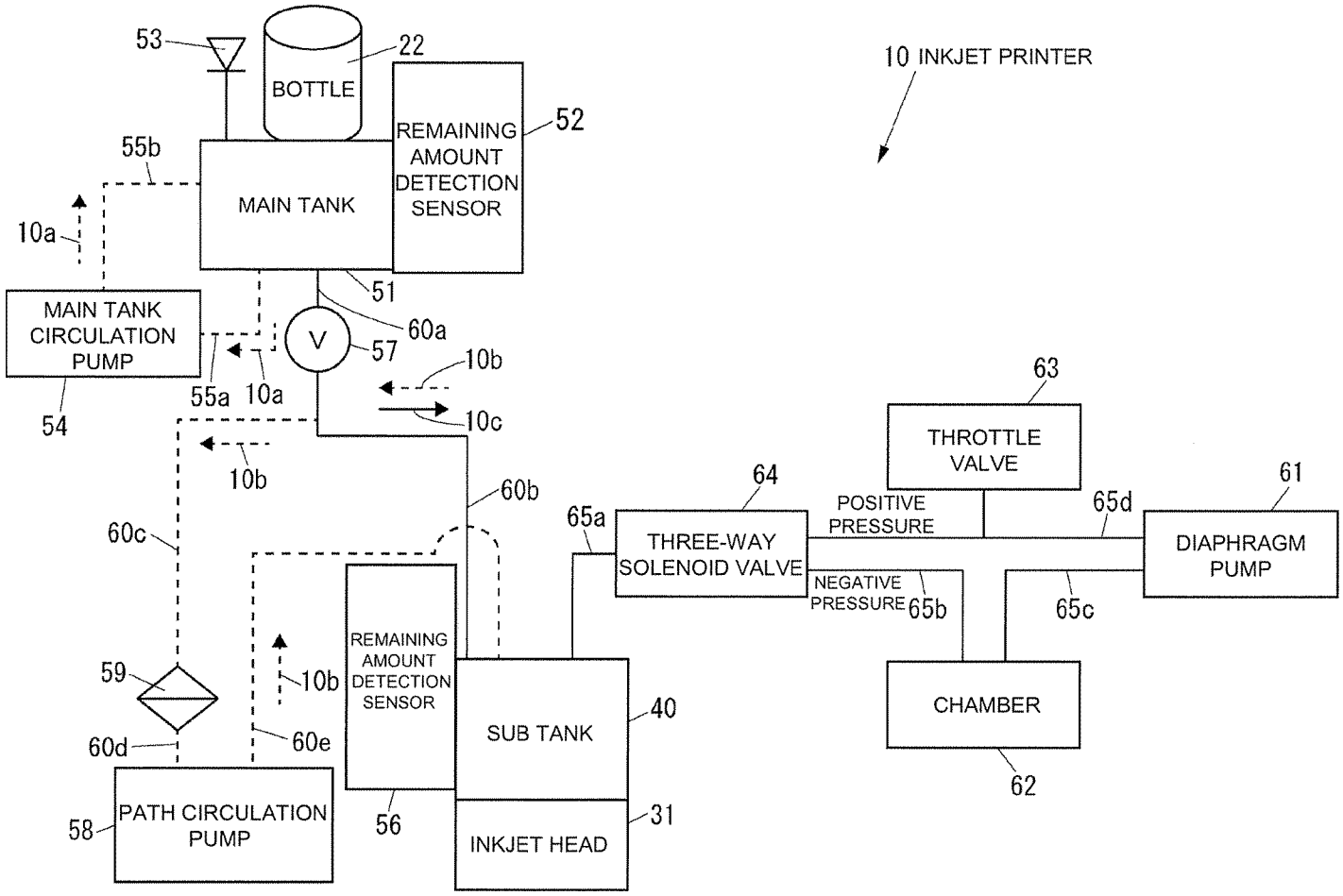
FIG. 7 is a diagram showing a path of fluid in printing in the inkjet printer shown in FIG. 1.

FIG. 7 is a diagram showing a path of fluid in printing in the inkjet printer 10.

As shown in FIG. 7, the inkjet printer 10 includes a main tank 51 which is disposed on the lower side in the vertical direction indicated by the arrow 11 (see FIG. 1) with respect to a bottle 22 and to which UV ink is supplied from the bottle 22, a remaining amount detection sensor 52 attached to the main tank 51 to detect a remaining amount of UV ink in the main tank 51, a check valve 53 which permits gas in the main tank 51 to flow out of the main tank 51 and prohibits the gas outside the main tank 51 from flowing into the main tank 51, a main tank circulation pump 54 for circulating the UV ink in the main tank 51 to prevent specific components in the UV ink from depositing, a path 55*a* causing a lower portion in the main tank 51 in the vertical direction to communicate with the main tank circulation pump 54, and a path 55*b* causing an upper portion in the main tank 51 in the vertical direction to communicate with the main tank circulation pump 54.

The inkjet printer 10 includes a remaining amount detection sensor 56 attached to the sub tank 40 to detect a remaining amount of UV ink in the sub tank 40, a pump 57 for supplying UV ink from the main tank 51 to the sub tank 40, a path circulation pump 58 for circulating the UV ink in the path and in the sub tank 40 to prevent specific components in the UV ink from depositing, a filter 59 for removing impurities in the UV ink circulated by the path circulation pump 58, a path 60*a* causing a lower portion in the main tank 51 in the vertical direction to communicate with the pump 57, a path 60*b* causing an upper portion in the sub tank 40 in the vertical direction to communicate with the pump 57, a path 60*c* causing the path 60*b* to communicate with the filter 59, a path 60*d* causing the path circulation pump 58 to communicate with the filter 59, and a path 60*e* causing an upper portion in the sub tank 40 in the vertical direction to communicate with the path circulation pump 58.

The inkjet printer 10 includes a diaphragm pump 61 which is a pump for making a pressure in a space 40*a* (will be described later) (see FIG. 9) in the sub tank 40 negative, a chamber 62 disposed on a negative-pressure side obtained by the diaphragm pump 61 to remove UV ink contained in gas, a throttle valve 63 disposed on a positive-pressure side obtained by the diaphragm pump 61 to control a pressure in the path, a three-way solenoid valve 64 controlling which of a negative pressure and a positive pressure obtained by the diaphragm pump 61 is caused to communicate with the sub tank 40, a path 65*a* causing an upper portion in the sub tank 40 in the vertical direction to communicate with the three-way solenoid valve 64, a path 65*b* causing the chamber 62 to communicate with the three-way solenoid valve 64, a path 65*c* causing the diaphragm pump 61 to communicate with chamber 62, and a path 65*d* causing the diaphragm pump 61 to communicate with the three-way solenoid valve 64.

Figure 8:
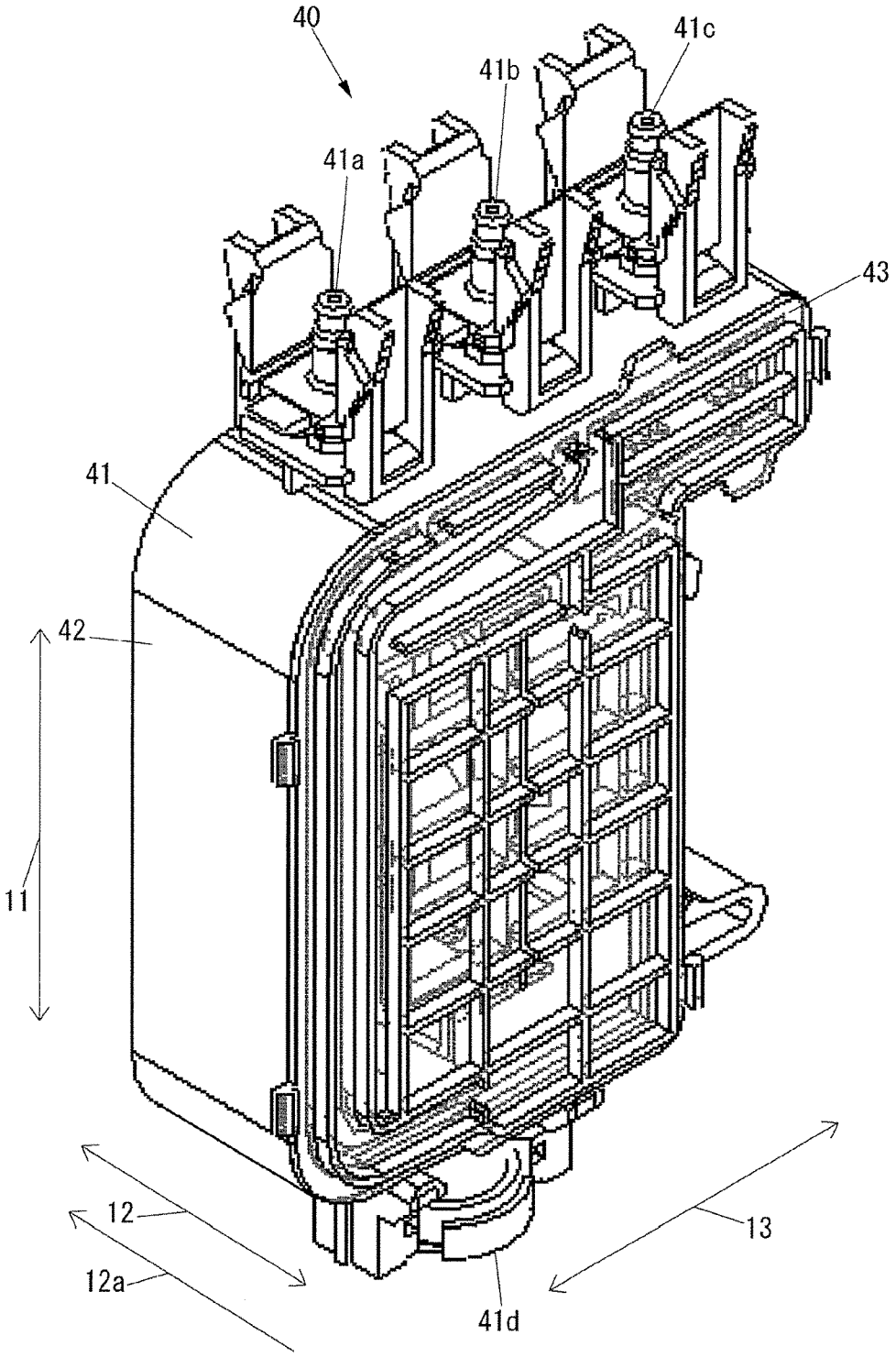
FIG. 8 is an external perspective view of the sub tank shown in FIG. 3.
Figure 9:
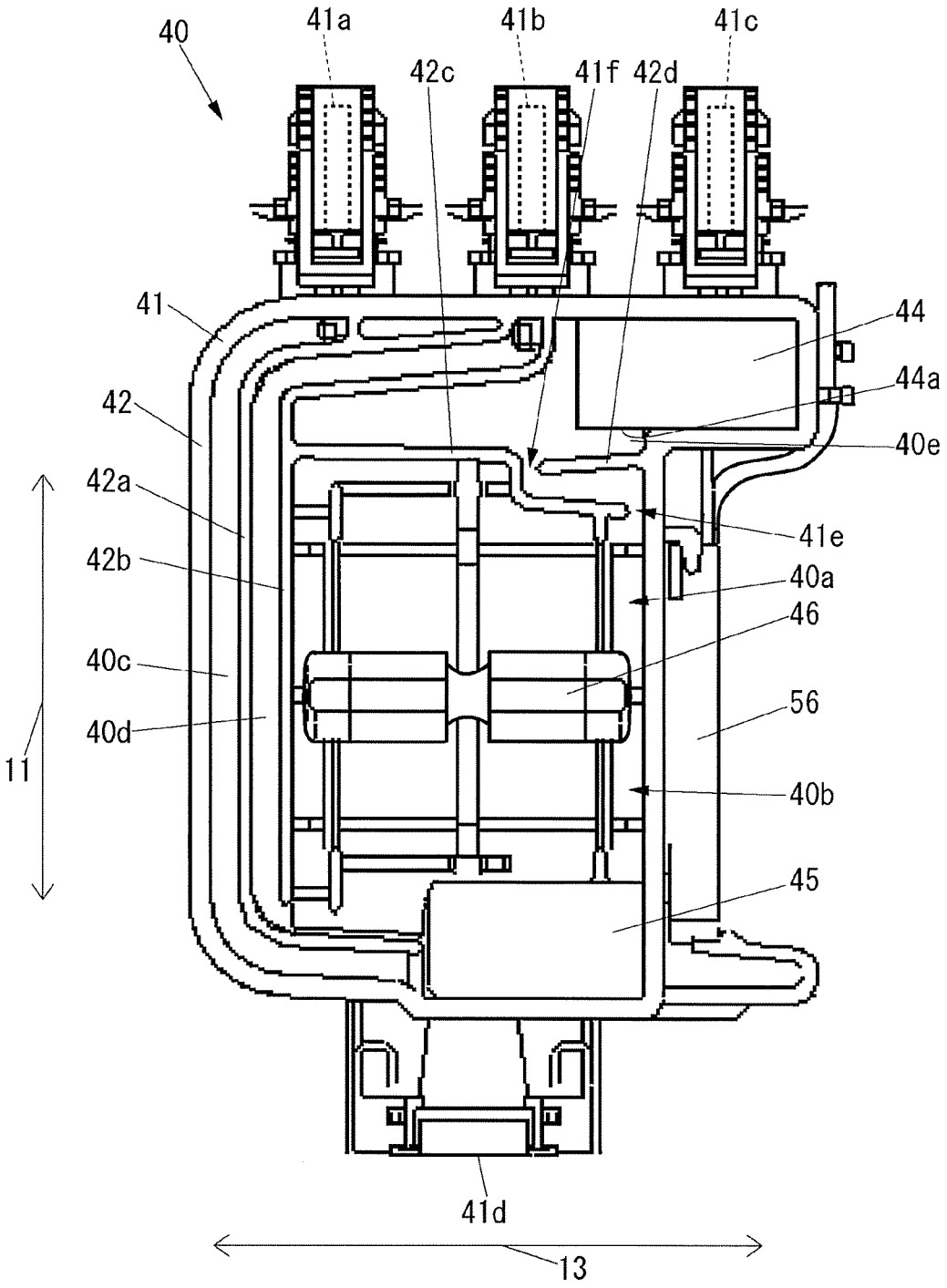
FIG. 9 is a side view of the sub tank shown in FIG. 3 in a state in which the cover is removed.

FIG. 8 is an external perspective view of the sub tank 40. FIG. 9 is a side view of the sub tank 40 in a state in which a cover 43 is removed.

As shown in FIGS. 8 and 9, the sub tank 40 includes a space forming unit 41 forming the space 40*a*. The space forming unit 41 includes a case 42 having walls 42*a*, 42*b*, 42*c*, and 42*d* partitioning the space 40*a* and the cover 43 attached to a side surface of the case 42 to form the space 40*a* together with the case 42.

The space forming unit 41 forms an ink supply port 41*a* communicating with the path 60*b* (see FIG. 7), an ink circulation port 41*b* communicating with the path 60*e* (see FIG. 7), a pump communication port 41*c* communicating with the path 65*a* (see FIG. 7), and a head communication port 41*d* communicating with the inkjet heads 31 (see FIG. 5).

The space 40*a* has an ink storage chamber 40*b* for storing UV ink, a supply flow path 40*c* serving as a flow path extending from the ink supply port 41*a* to the ink storage chamber 40*b*, a circulation flow path 40*d* serving as a flow path extending from the ink circulation port 41*b* to the ink storage chamber 40*b*, and a gas storage chamber 40*e* disposed between the ink storage chamber 40*b* and the pump communication port 41*c*. The supply flow path 40*c* is partitioned from the ink storage chamber 40*b* and the circulation flow path 40*d* with the wall 42*a*. The circulation flow path 40*d* is partitioned from the ink storage chamber 40*b* and the gas storage chamber 40*e* with the wall 42*b*. The gas storage chamber 40*e* is partitioned from the ink storage chamber 40*b* with the walls 42*c* and 42*d*.

The case 42 and the cover 43 are made of a hard resin such as PP (polypropylene) to have a thickness at which the case and the cover are difficult to be deformed. The cover 43 may be made of a material other than PP. However, for example, the cover 43 is preferably made of a material such as aluminum which cannot be easily dissolved by monomer components in UV ink similarly to the PP. Further, the cover 43 may be a thin film-like part. However, when the cover 43 is a film-like part, the cover 43 expands outside the space 40*a* when the cover 43 receives a pressure from the inside of the space 40*a* due to storage or the like of UV ink in the space 40*a*, and the cover 43 is easily peeled off from the case 42.

When the cover 43 is a thin film-like part, the case 42 and the cover 43 may be fixed to each other by thermal welding. However, when the case 42 and the cover 43 are fixed to each other by thermal welding, a die for thermal welding is required for each type of the sub tanks 40 to disadvantageously increase the cost. Here, laser welding is a processing method capable of coping with fixing of objects having various shapes by a single laser welding machine merely by changing data for indicating positions to be irradiated with a laser. Therefore, when the case 42 and the cover 43 are made of a hard resin such as PP to have a thickness at which the case and the cover are difficult to be deformed, the case 42 and the cover 43 are preferably fixed to each other by laser welding which can easily cope with various types of the sub tanks 40 by a single laser welding machine.

The cover 43 is preferably transparent or semitransparent such that a user can check a situation of UV ink or the like in the space 40*a*.

The sub tank 40 includes a liquid-proof ventilation filter 44 disposed at a position where the liquid-proof ventilation filter 44 closes a flow path to the pump communication port 41*c* in the gas storage chamber 40*e*, an ink circulation filter 45 disposed at a position where the ink circulation filter 45 closes a flow path to the head communication port 41*d* in the ink storage chamber 40*b*, and a float 46 which is disposed in the ink storage chamber 40*b* so as to be movable in the vertical direction and floats on the UV ink in the ink storage chamber 40*b*.

The liquid-proof ventilation filter 44 prevents UV ink from flowing via gas to prevent the UV ink from flowing out from the space 40*a* to the pump communication port 41*c*. Since the liquid-proof ventilation filter 44 is, for example, a film made of PTFE (polytetrafluoroethylene), when the UV ink flowing from the space 40*a* side to the pump communication port 41*c* side comes into contact with the liquid-proof ventilation filter 44 to pool the UV ink on a surface 44*a* due to, for example, surface tension or the like, the UV ink can be removed from the surface 44*a* by gas flowing from the pump communication port 41*c* side to the space 40*a* side. When a positive pressure is applied from the pump communication port 41*c* to the space 40*a*, the liquid-proof ventilation filter 44 is disposed at a position where the gas fed from the pump communication port 41*c* to the space 40*a* passes.

The ink distribution filter 45 traps substances which aggregate to cause clogging of the nozzles 31*a* of the inkjet heads 31 to prevent the substances from going to the inkjet head 31 (see FIG. 5) side.

The float 46 includes, for example, a magnet, and causes the remaining amount detection sensor 56 to detect a position of the magnet in the vertical direction so as to cause the remaining amount detection sensor 56 to detect a position of a liquid level of UV ink in the ink storage chamber 40*b* in the vertical direction.

The space forming unit 41 includes bubble circulation interruption portions 41*e* and 41*f* which narrow a flow path of gas flowing between the ink storage chamber 40*b* and the liquid-proof ventilation filter 44 to interrupt circulation of bubbles of UV ink from the ink storage chamber 40*b* side to the liquid-proof ventilation filter 44 side. Since the bubble circulation interruption portions 41*e* and 41*f* have narrow flow paths, respectively, bubbles of UV ink can be eliminated. The bubble circulation interruption portions 41*e* and 41*f* are disposed on the upper side in the vertical direction of the upper limit of the liquid level of UV ink set in the ink storage chamber 40*b*, that is, of the upper limit of the liquid level of UV ink set by the remaining amount detection sensor 56.

In addition, bubbles in the ink storage chamber 40*b* may be generated by various causes. For example, when the meniscus of the nozzle 31*a* collapses in each of the inkjet heads 31, gas entering the inkjet head 31 via the nozzle 31*a* may form bubbles.

The supply flow path 40*c* and the circulation flow path 40*d* communicate with the ink storage chamber 40*b* on the lower side in the vertical direction of the lower limit of the liquid level of UV ink set in the ink storage chamber 40*b*, that is, of the lower limit of the liquid level of UV ink set by the remaining amount detection sensor 56.

Figure 10:
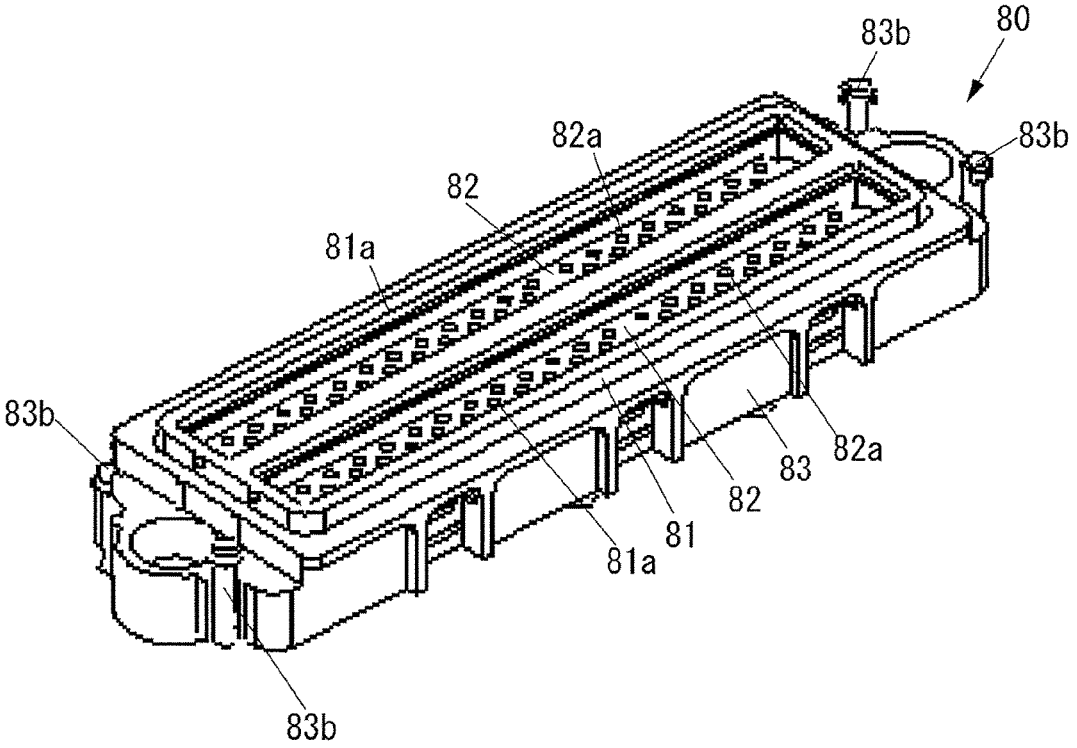
FIG. 10 is an external perspective view of a cap for cleaning the inkjet head shown in FIG. 3.
Figure 11:
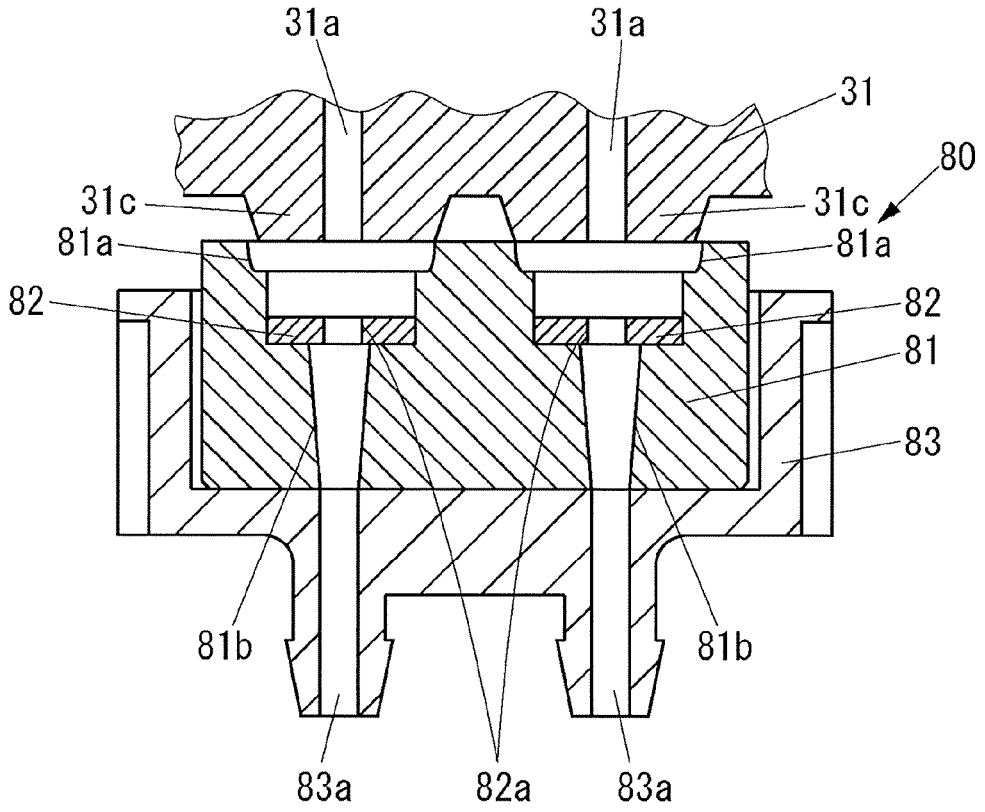
FIG. 11 is a front sectional view of a cap in cleaning the inkjet head shown in FIG. 3.

FIG. 10 is an external perspective view of a cap 80 for cleaning the inkjet head 31. FIG. 11 is a front cross-sectional view of the cap 80 in cleaning the inkjet head 31.

As shown in FIGS. 10 and 11, the inkjet printer 10 includes the cap 80 for cleaning the inkjet head 31. The cap 80 is disposed, for example, at a retracted position of the inkjet head 31 in the inkjet printer 10, that is, at a position near an end in an opposite direction of the direction indicated by the arrow 12*a*.

The inkjet head 31 includes a protruding portion 31*c* protruding in a discharge direction of UV ink and having the nozzle row 31*b* formed on the surface thereof. The protrusion 31*c* extends in the extending direction of the nozzle row 31*b* (see FIG. 4).

The cap 80 includes a member 81 having a groove 81*a* formed therein and corresponding to the protruding portion 31*c* of the inkjet head 31, a plate-shaped member 82 disposed in the groove 81*a* of the member 81 and having a large number of holes 82*a* formed therein, and a support member 83 which has a pump hole 83*a* formed therein and communicating with a pump 91 (will be described later) (see FIG. 12) and supports the member 81. In the member 81, a hole 81*b* which causes the hole 82*a* of the member 82 to communicate with the pump hole 83*a* of the support member 83 is formed. The support member 83 has four protruding portions 83*b* for fixing a spacer 100 (will be described later) (see FIG. 13). The protrusion 83*b* becomes gradually thick toward the distal end thereof.

Figure 12:
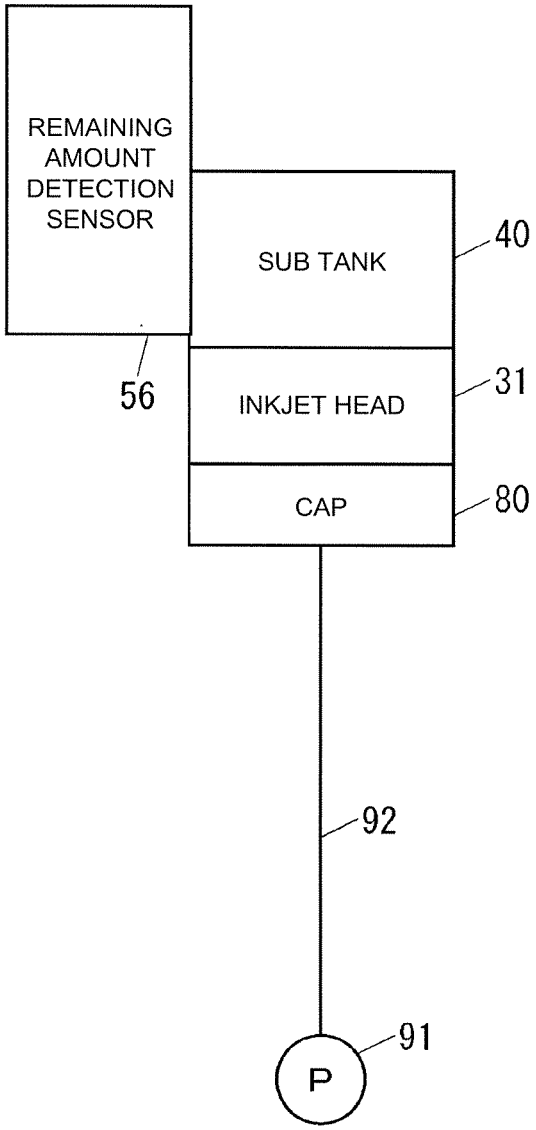
FIG. 12 is a diagram showing a path of a fluid in cleaning in the inkjet printer shown in FIG. 1.

FIG. 12 is a diagram showing a path of a fluid in cleaning in the inkjet printer 10.

As shown in FIG. 12, the inkjet printer 10 includes the pump 91 for recovering UV ink via the cap 80, and a path 92 causing the pump hole 83*a* (see FIG. 11) of the cap 80 and the pump 91 to communicate with each other.

Figure 13:
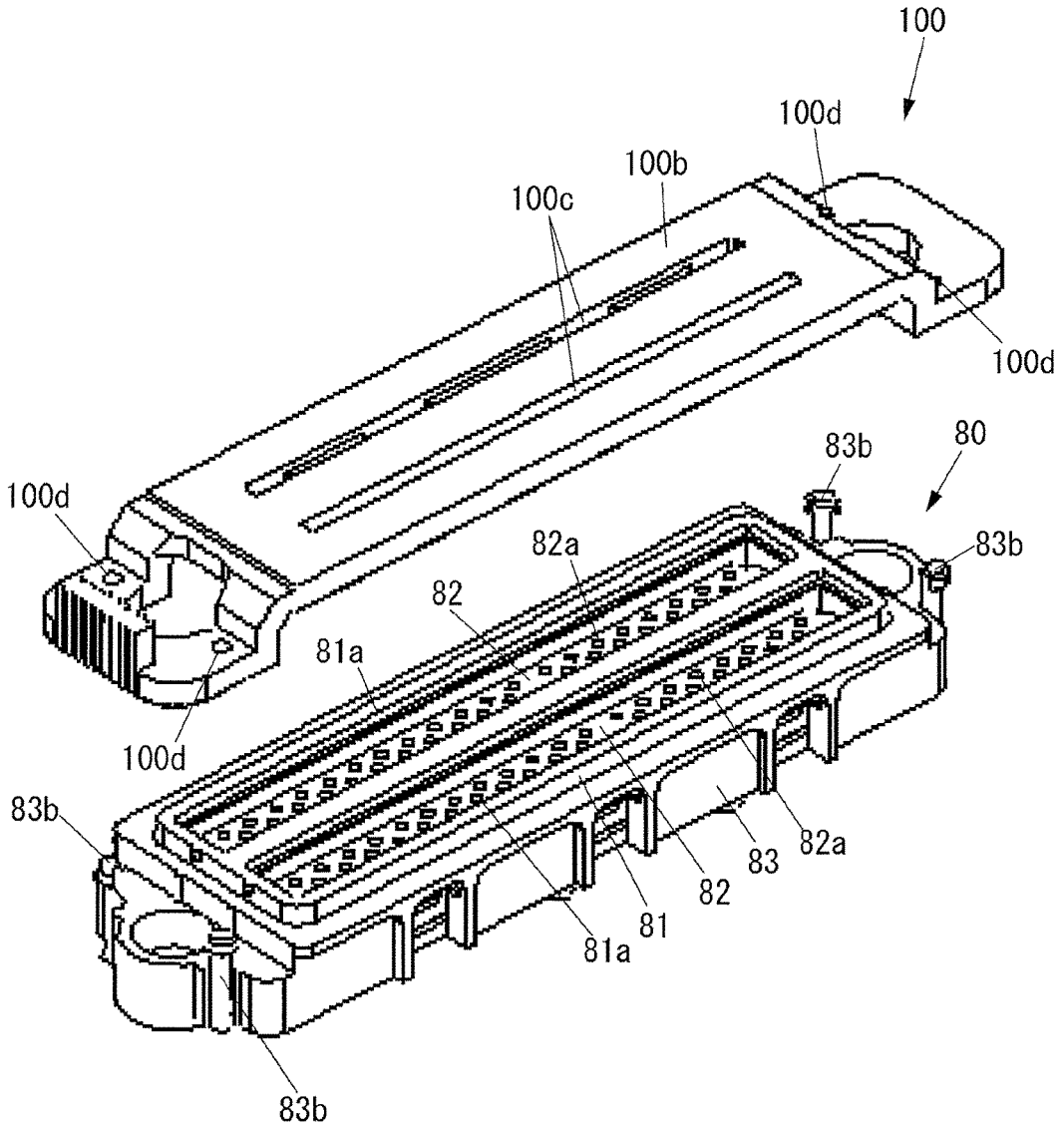
FIG. 13 is an exploded perspective view of the cap shown in FIG. 10 and a spacer.
Figure 14:
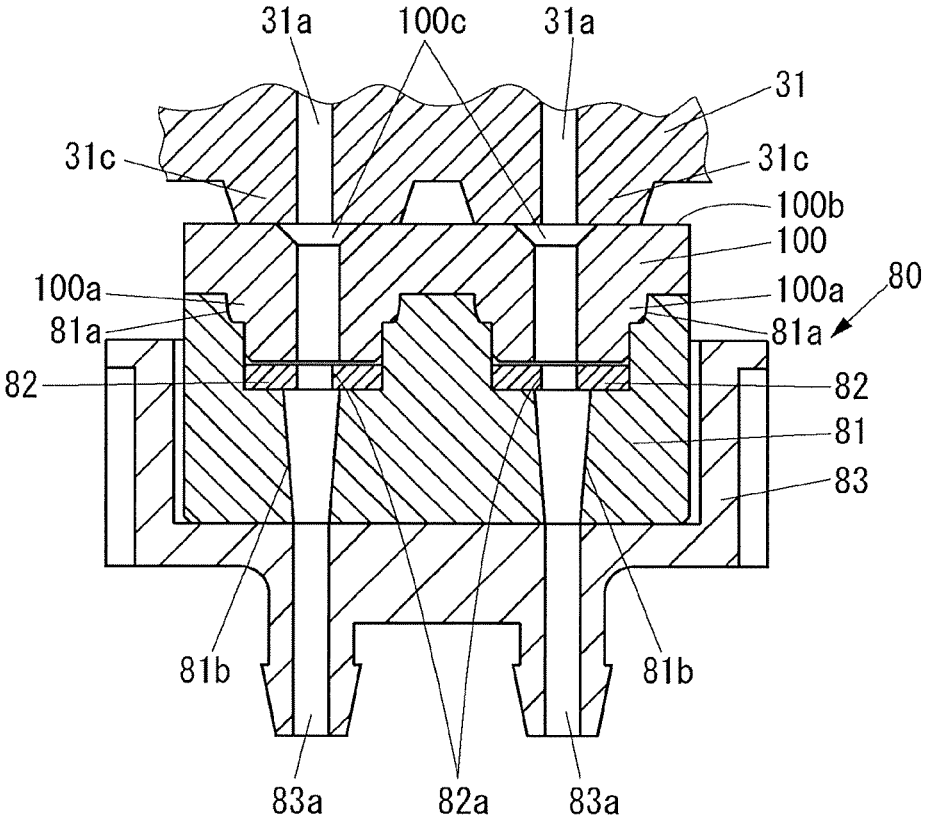
FIG. 14 is a front cross-sectional view of the cap and the spacer shown in FIG. 13 in an initial filling state of UV ink to the inkjet head.

FIG. 13 is an exploded perspective view of the cap 80 and the spacer 100. FIG. 14 is a front sectional view of the cap 80 and the spacer 100 when the inkjet head 31 is initially filled with UV ink.

As shown in FIGS. 13 and 14, the spacer 100 includes a protruding portion 100*a* corresponding to the groove 81*a* of the member 81 of the cap 80 and a flat portion 100*b* with which the protruding portion 31*c* of the inkjet head 31 is in close contact.

The spacer 100 is, for example, a part made of silicone rubber and is a soft part having a hardness of about 30 degrees. Since fluorocarbon rubber having high resistance to UV ink basically has a high hardness, when the spacer 100 is made of fluorocarbon rubber, the inkjet head 31 is hard to be brought into close contact with the spacer 100. However, even though the inkjet head 31 having a shape difficult to be brought into close contact with the spacer 100 when the spacer 100 is made of fluorocarbon rubber is employed, the spacer 100 is made of silicone rubber having a low hardness to make it possible to bring the inkjet head 31 into contact with the spacer 100.

In the spacer 100, the nozzle 31*a* of the inkjet head 31, a hole 100*c* communicating with a hole 82*a* of a member 82 of the cap 80, and a hole 100*d* into which the protruding portion 83*b* of the support member 83 of the cap 80 is inserted are formed. The diameter of the hole 100*d* is smaller than the diameter of the distal end of the protruding portion 83*b*. When the spacer 100 is fixed to the cap 80, an operator pushes the spacer 100 against the cap 80 such that the protruding portions 83*b* is inserted from one side of the hole 100*d* so as to extend the hole 100*d* in diameter by the distal end of the protruding portion 83*b*. Thereafter, the distal end of the protruding portion 83*b* comes out from the other end side of the hole 100*d* to make it possible to prevent the spacer 100 from being easily removed from the cap 80. When the spacer 100 is removed from the cap 80, the operator pulls the spacer 100 in a direction away from the cap 80 such that the protruding portions 83*b* is removed from the hole 100*d* so as to extend the hole 100*d* by the protruding portion 83*b* of the support member 83 of the cap 80. Thereafter, the spacer 100 can be removed from the cap 80.

Figure 15:
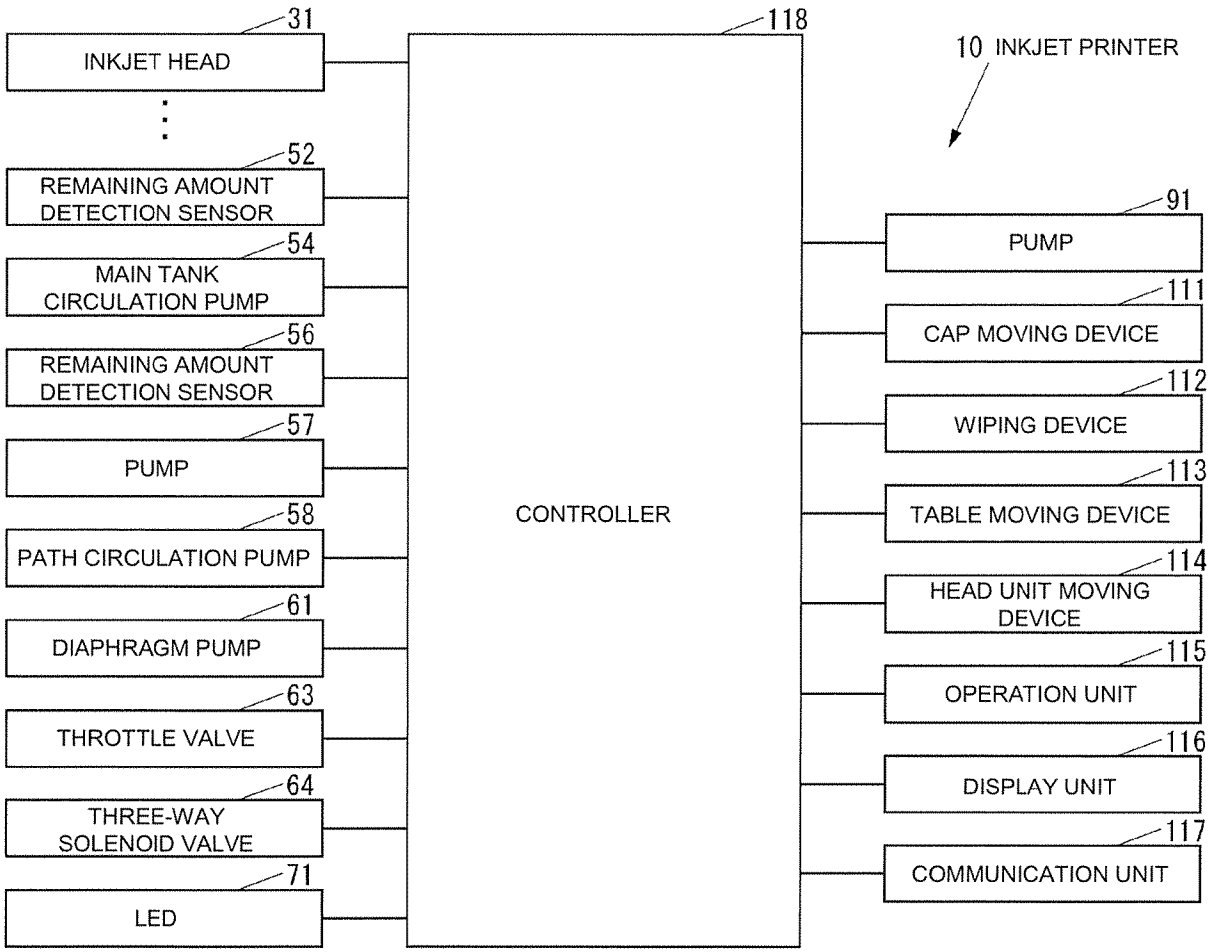
FIG. 15 is a block diagram of the inkjet printer shown in FIG. 1.

FIG. 15 is a block diagram of the inkjet printer 10.

As shown in FIG. 15, the inkjet printer 10 includes a cap moving device 111 moving the cap 80 (see FIG. 10) in the vertical direction indicated by the arrow 11 (see FIG. 1), a wiping device 112 wiping a surface of the inkjet head 31 on which the nozzle 31*a* is formed, a table moving device 113 moving the table 24 (see FIG. 2) in the sub scanning direction indicated by the arrow 13 (see FIG. 1) with respect to the head unit 30 (see FIG. 2), a head unit moving device 114 moving the head unit 30 in the main scanning direction indicated by the arrow 12 (see FIG. 1) with respect to the table 24, an operation unit 115 serving as an operation device such as buttons by which various operations are input, a display unit 116 serving as a display device such as an LCD (Liquid Crystal Display) displaying various pieces of information, a communication unit 117 serving as a communication device directly communicating with an external device by wire or by air without passing through a network such as a LAN (Local Area Network) or through the network, and a controller 118 controlling the inkjet printer 10 as a whole.

The controller 118 includes, for example, a CPU (Central Processing Unit), a ROM (Read Only Memory) in which a program and various data are stored in advance, and a RAM (Random Access Memory) used as a work area for the CPU. The CPU executes a program stored in the ROM.

The operation of the inkjet printer 10 will be described below.

First, the operation of the inkjet printer 10 when the inkjet head 31 is initially filled with UV ink will be described.

As shown in FIG. 14, after an operator attaches the spacer 100 to the cap 80, the operator can instruct the inkjet printer 10 to initially fill the inkjet head 31 with UV ink through the operation unit 115.

Therefore, the controller 118 operates the head unit moving device 114 such that the position of the inkjet head 31 becomes the position of the cap 80 in the main scanning direction indicated by the arrow 12.

Next, the controller 118 causes the cap moving device 111 to change the position of the cap 80 in the vertical direction indicated by the arrow 11 to bring the spacer 100 into close contact with the surface of the inkjet head 31 on which the nozzle 31*a* is formed as shown in FIG. 14.

Subsequently, the controller 118 causes the pump 91 to suck gas so as to make a pressure in the inkjet head 31 negative through the path 92, the pump hole 83*a* of the support member 83, the hole 81*b* of the member 81, the hole 82*a* of the member 82, the hole 100*c* of the spacer 100, the nozzle 31*a* of the inkjet head 31 in the order named. Therefore, the inkjet head 31 is filled with UV ink supplied from the sub tank 40.

After the above operation is completed, the operator removes the spacer 100 from the cap 80.

The inkjet printer 10 can also utilize a water head difference (position head) generated between the sub tank 40 and the inkjet head 31 to make it possible to naturally supply UV ink from the sub tank 40 to the inkjet head 31. However, since the viscosity of the UV ink is high, a long time, for example, about 40 minutes is required.

The above description explains the case in which the inkjet head 31 is initially filled with UV ink. However, the same applies to the case in which the inkjet head 31 which has been already filled with UV ink of some color is filled with UV ink of a new color. Further, also when air bubbles are mixed in the inkjet head 31 to cause the inkjet head 31 to defectively discharge UV ink and when air bubbles are removed from the inside of the inkjet head 31, air bubbles can be removed from the inside of the inkjet head 31 by the same operation.

The operation of the inkjet printer 10 in circulation of UV ink will be described below.

Since the controller 118 operates the main tank circulation pump 54 at a specific timing to circulate the UV ink in the main tank 51 as indicated by an arrow 10*a* in FIG. 7, a specific component in the UV ink can be prevented from being deposited.

In addition, since the controller 118 operates the route circulation pump 58 at a specific timing to circulate the UV inks in the paths 60*b* to 60*e* and in the sub tank 40 as indicated by the arrow 10*b* in FIG. 7, a specific component in the UV ink can be prevented from being deposited.

The operation of the inkjet printer 10 when the negative pressure in the inkjet head 31 is maintained will be described below.

When the controller 118 operates the diaphragm pump 61 to cause the three-way solenoid valve 64 to communicate the path 65*a* and the path 65*b* with each other, the space 40*a* in the sub tank 40 can be kept at a negative pressure. When the space 40*a* in the sub tank 40 is kept at a negative pressure, the inside of the inkjet head 31 communicating with the space 40*a* is also kept at a negative pressure. Therefore, in the inkjet head 31, a meniscus is formed in the nozzle 31*a* to make it possible to execute appropriate printing.

The operation of the inkjet printer 10 in execution of printing will be described below.

The controller 118 controls the inkjet head 31, the LED 71, the table moving device 113, and the head unit moving device 114 based on the print data input via the communication unit 117. More specifically, every time the table moving device 113 changes the position of the table 24 in the sub scanning direction indicated by the arrow 13 with respect to the head unit 30, the controller 118 causes the inkjet heads 31 to discharge UV ink toward the medium on which printing is executed on the table 24 to adhere the UV ink on the medium on which printing is executed while causing the head unit moving device 114 to move the head unit 30 in an opposite direction of the direction indicated by an arrow 12*a* of the main scanning directions indicated by the arrow 12, and causes the LED 71 to irradiate the UV ink on the medium on which printing is executed on the table 24 with ultraviolet rays to cure the UV ink so as to form an image based on print data on the medium on which printing is executed with the UV ink.

Note that the controller 118 can maintain a state in which UV ink the amount of which is a predetermined amount or more is always stored in the ink storage chamber 40*b* of the sub tank 40. More specifically, when the liquid level of the UV ink in the ink storage chamber 40*b* reaches the lower limit or a specific position above the lower limit based on a detection result of the remaining amount detection sensor 56, the controller 118 causes the pump 57 to supply UV ink from the main tank 51 to the sub tank 40 as indicated by an arrow 10*c* in FIG. 7 until the liquid level of the UV ink in the ink storage chamber 40*b* reaches the upper limit or a specific position below the upper limit. Here, when the UV ink in the bottle 22 empties such that the liquid level of the UV ink in the main tank 51 reaches the lower limit or a specific position above the lower limit, the controller 118 can notify a user of an instruction for replacement of the bottles 22 through a device such as the display unit 116.

The operation of the inkjet printer 10 in cleaning of the inkjet head 31 will be described below.

The controller 118 executes a cleaning operation of the inkjet head 31 at a specific timing. Specifically, the controller 118 operates the head unit moving device 114 such that the position of the inkjet head 31 becomes the position of the cap 80 in the main scanning direction indicated by the arrow 12.

Next, the controller 118 changes the position of the cap 80 in the vertical direction indicated by the arrow 11 to the cap moving device 111 to cause the protruding portion 31*c* of the inkjet head 31 to come close to the groove 81*a* of the cap 80 as shown in FIG. 11.

Next, the controller 118 moves the diaphragm pump 61 to cause the path 65*a* and the path 65*d* to communicate with each other with the three-way solenoid valve 64 to make it possible to make the pressure in the space 40*a* in the sub tank 40 positive. When the pressure in the space 40*a* in the sub tank 40 is made positive, a pressure in the inkjet head 31 communicating with the space 40*a* is also made positive. Therefore, in the inkjet head 31, UV ink flows down from the nozzle 31*a*. That is, the controller 118 executes purging. The UV ink flowing down from the nozzle 31*a* is pooled in the groove 81*a* of the cap 80.

Note that the controller 118 collects the UV ink pooled in the groove 81*a* of the cap 80 by the pump 91.

After execution of the purge, the controller 118 moves the diaphragm pump 61 to cause the three-way solenoid valve 64 to communicate the path 65*a* and the path 65*b* with each other so as to keep the space 40*a* in the sub tank 40 at a negative pressure. When the space 40*a* in the sub tank 40 is kept at a negative pressure, the inside of the inkjet head 31 communicating with the space 40*a* is also kept at a negative pressure.

Subsequently, the controller 118 changes the position of the cap 80 in the vertical direction indicated by the arrow 11 to the position of the cap moving device 111 to move the protruding portion 31*c* of the inkjet head 31 away from the groove 81*a* of the cap 80. Thereafter, the controller 118 operates the head unit moving device 114 such that the position of the inkjet head 31 reaches the position of the wiping device 112 in the main scanning direction indicated by the arrow 12.

Next, the controller 118 causes the wiping device 112 to wipe the surface of the inkjet head 31 on which the nozzle 31*a* is formed.

In the above description, when a pressure in the space 40*a* in the sub tank 40 is made positive, the UV ink contacts the liquid-proof ventilation filter 44 and pools on the surface 44*a* of the liquid-proof air filter 44 due to, for example, surface tension or the like, the UV ink pooling on the surface 44*a* of the liquid-proof ventilation filter 44 is removed from the surface 44*a* of the liquid-proof ventilation filter 44 by gas fed from the pump communication port 41*c* into the space 40*a* and passing through the liquid-proof ventilation filter 44 from the pump communication port 41*c* side to the bubble flow disturbance portion 41*e* side. That is, the liquid-proof ventilation filter 44 can be restored when the ink pools on the surface 44*a*. Therefore, the controller 118 may execute the above-described operation to restore the liquid-proof ventilation filter 44.

As described above, in the inkjet printer 10, since the liquid-proof ventilation filter 44 preventing UV ink from flowing out from the space 40*a* in the sub tank 40 to the diaphragm pump 61 side is disposed in the space 40*a* in the sub tank 40, the configuration preventing UV ink from flowing out from the space 40*a* in the sub tank 40 to the diaphragm pump 61 side need not be disposed independently of the sub tank 40. Therefore, in the inkjet printer 10, the structure for making the pressure in the space 40*a* in the sub tank 40 negative can be made smaller than that in a conventional inkjet printer.

In addition, since the number of parts of the inkjet printer 10 is smaller than that in the case where the configuration preventing the UV ink from flowing out from the space 40*a* in the sub tank 40 to the diaphragm pump 61 side is provided independently of the sub tank 40, the manufacturing steps can be simplified.

The performance of the liquid-proof ventilation filter 44 which allows gas to pass through and does not allow the UV ink to pass through is deteriorated when UV ink contacts the liquid-proof ventilation filter 44 to pool the UV ink on the surface 44*a* of the liquid-proof ventilation filter 44 due to, for example, surface tension or the like. In the inkjet printer 10, even though bubbles are generated in the UV ink in the ink storage chamber 40*b*, since the bubble circulation interruption portions 41*e* and 41*f* can interrupt reaching of the bubbles of the UV ink to the liquid-proof ventilation filter 44, a period in which the performance of the liquid-proof ventilation filter 44 is maintained can be elongated.

Since the inkjet printer 10 can interrupt reaching of the bubbles of UV ink to the liquid-proof ventilation filter 44 by the bubble circulation interruption portions 41*e* and 41*f*, a length from the upper limit of the liquid level of the UV ink to the liquid-proof ventilation filter 44 in the vertical direction can be reduced. Therefore, the sub tank 40 can be reduced in size.

In the inkjet printer 10, even though UV ink contacts the liquid-proof ventilation filter 44 and pools on the surface 44*a* of the liquid-proof ventilation filter 44 due to, for example, the surface tension or the like, a positive pressure is applied from the pump communication port 41*c* to the space 40*a* in the sub tank 40 to make it possible to remove the UV ink pooling on the surface 44*a* of the liquid-proof ventilation filter 44 from the surface 44*a* of the liquid-proof ventilation filter 44, and thus the liquid-proof ventilation filter 44 can be easily restored.

The inkjet printer 10 may include a filter which cannot be restored even though a gas is circulated as the liquid-proof ventilation filter 44. For example, when the liquid-proof ventilation filter 44 is a film made of PTFE, the liquid-proof ventilation filter 44 has a flat shape and a pore diameter of 5 μm, so that the liquid-proof ventilation filter 44 can be restored by circulating gas therein. However, when the liquid-proof ventilation filter 44 is made of non-woven fabric of PTFE, the liquid-proof ventilation filter 44 is three-dimensional and has a pore diameter of, for example, 0.5 μm, so that the liquid-proof ventilation filter 44 cannot be restored even by allowing the gas to be circulated.

In the inkjet printer 10, since the flow path 40*c* for supplying UV ink from the main tank 51 to the ink storage chamber 40*b* communicates with the ink storage chamber 40*b* on the lower side in the vertical direction of the lower limit of the liquid level of the UV ink set in the ink storage chamber 40*b*, bubbles of the UV ink in the ink storage chamber 40*b* can be prevented from being generated by supplying the UV ink from the main tank 51. Therefore, since the inkjet printer 10 can inhibit bubbles of UV ink from reaching the liquid-proof ventilation filter 44, a period for which performance of the liquid-proof ventilation filter 44 is maintained can be elongated.

Similarly, in the inkjet printer 10, since the circulation flow path 40*d* communicates with the ink storage chamber 40*b* on the lower side in the vertical direction of the lower limit of the liquid level of the UV ink set in the ink storage chamber 40*b*, bubbles of UV ink in the ink storage chamber 40*b* can be inhibited from being generated by supplying UV ink from the flow path 40*d*. Therefore, since the inkjet printer 10 can inhibit bubbles of UV ink from reaching the liquid-proof air filter 44, a period for which performance of the liquid-proof ventilation filter 44 is maintained can be elongated.

The part accuracy of the inkjet head 31 and the cap 80 and the positional accuracy when the inkjet head 31 and the cap 80 are moved are difficult to be improved. Therefore, in the inkjet printer 10, the protruding portion 31*c* of the inkjet head 31 cannot be easily brought into close contact with the cap 80 without using the spacer 100. However, in the inkjet printer 10, since the protrusion 31*c* of the inkjet head 31 is brought into close contact with the flat portion 100*b* of the soft spacer 100, the UV ink can be appropriately sucked from the nozzle 31*a* of the inkjet head 31 by the pump 91.

When the spacer 100 is made of silicone rubber, the spacer 100 has low resistance to UV ink. Therefore, as the spacer 100, a part made of, for example, fluorocarbon rubber which has high resistance to UV ink may be used. However, the part made of fluorocarbon rubber has a hardness of, for example, about 70 degrees which is excessive higher than that of a part made of silicone rubber. Therefore, when the spacer 100 is a part made of fluorocarbon rubber, the spacer 100 causes the same problem posed in a configuration in which the protrusion 31*c* of the inkjet head 31 is pressed against the cap 80 without using the spacer 100.

Since the inkjet printer 10 includes the silicone rubber spacer 100 which can be removed from the cap 80, in comparison with a configuration in which the cap 80 itself is made of silicone rubber, the cap 80 is made of a material having a high resistance to UV ink to make it possible to improve the long-term reliability of the cap 80 used for cleaning the inkjet head 31.

Since the spacer 100 is used when the inkjet head 31 is initially filled with UV ink as described above, the spacer 100 is used at a low frequency. Therefore, the spacer 100 need only be disposable.

The inkjet printer 10 includes the bottle 22 and the main tank 51 in the above description. However, the inkjet printer 10 may have a configuration in which the bottle 22 and the main tank 51 are not disposed and UV ink is supplied to the inkjet head 31 by only an ink tank similar to the sub tank 40. In such a configuration, every time the ink in the ink tank becomes empty, a user replaces the ink tank with a new ink tank. When ink tanks are replaced, UV ink may adhere to the liquid-proof ventilation filter in the new ink tank. However, since the ink tank similar to the sub tank 40 can restore the performance of the liquid-proof ventilation filter as described above, the ink tank can be used without any problem.

Figure 16:
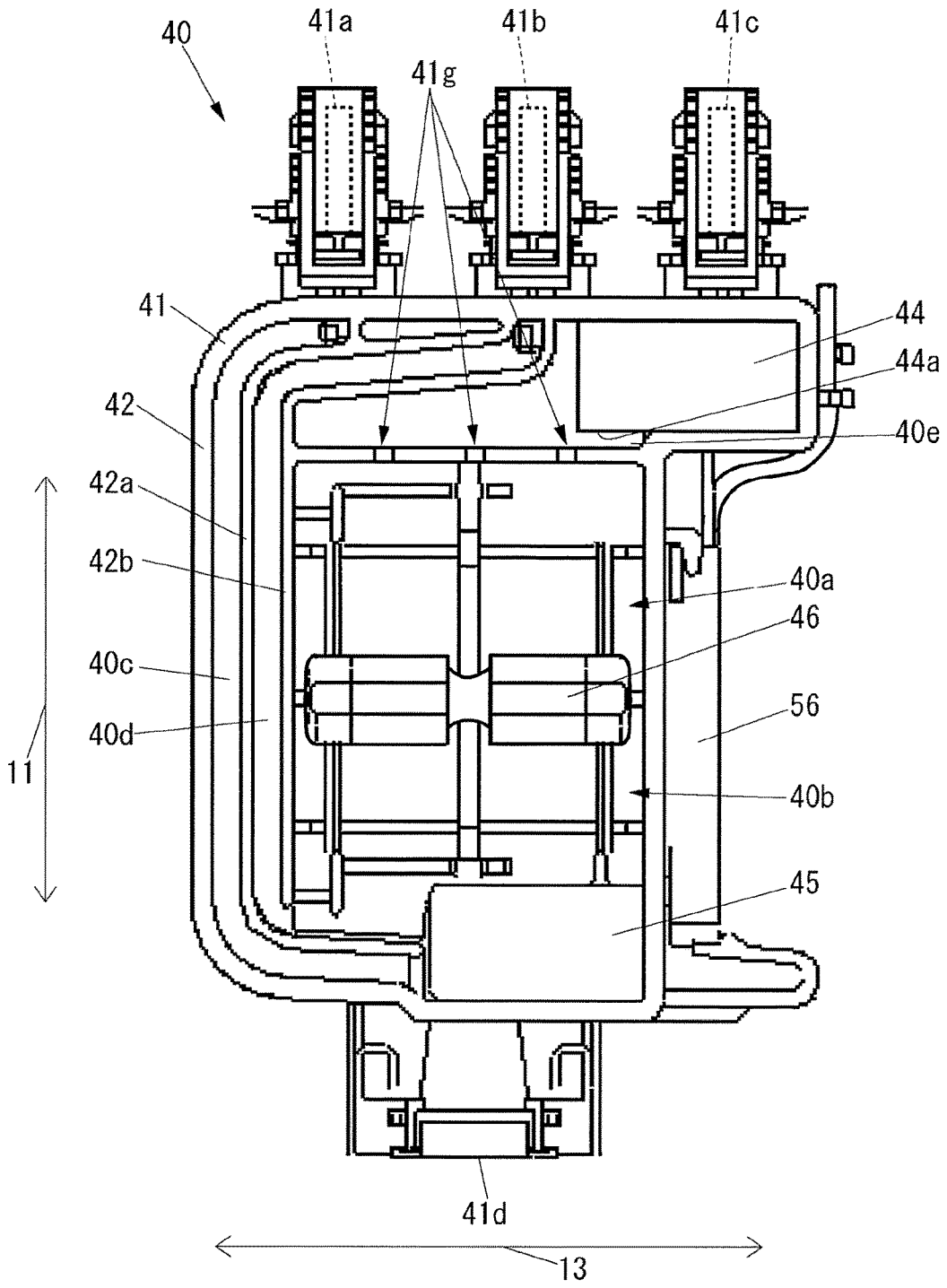
FIG. 16 is a side view of an example of the sub tank shown in FIG. 3 in a state in which the cover is removed, the example being different from the example shown in FIG. 9.

The bubble circulation interruption portion need not have the shape described above. For example, as shown in FIG. 16, the sub tank 40 may employ a portion having a hole formed in the wall thereof as the bubble circulation interruption portion 41*g*.

In this embodiment, UV ink is employed as the ink of the disclosure. However, the ink tank and the inkjet printer according to the disclosure may handle inks other than UV ink.

What is claimed is:

1. An ink tank which is mounted in an inkjet printer having an inkjet head for discharging ink and supplies ink to the inkjet head, comprising:

a space forming unit which forms a space including an ink storage chamber for storing ink and a pump communication port communicating with a pump for making a pressure in the space negative; and a liquid-proof ventilation filter which is disposed in the space, allows gas to be circulated, and does not allow the ink to be circulated so as to prevent the ink from flowing out from the space to the pump communication port, wherein, in the space forming unit, an ink supply port to which ink is supplied from a main tank included in the inkjet printer and a supply flow path serving as a flow path extending from the ink supply port to the ink storage chamber are formed, the supply flow path communicates with the ink storage chamber on a lower side of a lower limit of an ink liquid level set in the ink storage chamber in a vertical direction, in a state in which the ink is stored, the ink storage chamber is divided into a liquid phase portion and a gas phase portion with the ink liquid level as a boundary, the gas phase portion communicates with the pump communication port and at least the gas phase portion is communicated with a negative-pressure adjusting unit via the liquid-proof ventilation filter.

2. The ink tank according to claim 1, wherein, when the ink flowing from the space side to the pump communication port side comes in contact with the liquid-proof ventilation filter and is pooled on a surface of the liquid-proof ventilation filter, the ink is adapted to be removed from the surface by the gas flowing from the pump communication port side to the space side, and the liquid-proof ventilation filter is disposed at a position through which the gas fed from the pump communication port to the space passes when a positive pressure is applied from the pump communication port to the space.

3. The ink tank according to claim 2, wherein, in the space forming unit, an ink supply port to which ink is supplied from a main tank included in the inkjet printer and a supply flow path serving as a flow path extending from the ink supply port to the ink storage chamber are formed, and, when the ink tank is mounted in the inkjet printer, the supply flow path communicates with the ink storage chamber on a lower side of a lower limit of an ink liquid level set in the ink storage chamber in a vertical direction.

4. The ink tank according to claim 1, wherein, the ink tank is mounted in the inkjet printer.

5. An ink tank which is mounted in an inkjet printer having an inkjet head for discharging ink and supplies ink to the inkjet head, comprising:

a space forming unit which forms a space including an ink storage chamber for storing ink and a pump communication port communicating with a pump for making a pressure in the space negative; and a liquid-proof ventilation filter which is disposed in the space, allows gas to be circulated, and does not allow the ink to be circulated so as to prevent the ink from flowing out from the space to the pump communication port, wherein the space forming unit includes a bubble circulation interruption portion that narrows a flow path of gas between the ink storage chamber and the liquid-proof ventilation filter to interrupt circulation of bubbles of ink from the ink storage chamber side to the liquid-proof ventilation filter side, and the bubble circulation interruption portion is disposed on an upper side of an upper limit of an ink liquid level set in the ink storage chamber in a vertical direction when the ink tank is mounted in the inkjet printer.

6. The ink tank according to claim 5, wherein, when the ink flowing from the space side to the pump communication port side comes in contact with the liquid-proof ventilation filter and is pooled on a surface of the liquid-proof ventilation filter, the ink is adapted to be removed from the surface by the gas flowing from the pump communication port side to the space side, and the liquid-proof ventilation filter is disposed at a position through which the gas fed from the pump communication port to the space passes when a positive pressure is applied from the pump communication port to the space.

7. The ink tank according to claim 6, wherein, in the space forming unit, an ink supply port to which ink is supplied from a main tank included in the inkjet printer and a supply flow path serving as a flow path extending from the ink supply port to the ink storage chamber are formed, and, when the ink tank is mounted in the inkjet printer, the supply flow path communicates with the ink storage chamber on a lower side of a lower limit of an ink liquid level set in the ink storage chamber in the vertical direction.

8. The ink tank according to claim 5, wherein, in the space forming unit, an ink supply port to which ink is supplied from a main tank included in the inkjet printer and a supply flow path serving as a flow path extending from the ink supply port to the ink storage chamber are formed, and, when the ink tank is mounted in the inkjet printer, the supply flow path communicates with the ink storage chamber on a lower side of a lower limit of an ink liquid level set in the ink storage chamber in the vertical direction.

9. An inkjet printer comprising:

an inkjet head for discharging ink;

an ink tank for supplying ink to the inkjet head; and a pump, wherein the ink tank includes a space forming unit forming a space including an ink storage chamber for storing ink and a pump communication port communicating with the pump, and a liquid-proof ventilation filter which is disposed in the space, allows gas to be circulated, and does not allow the ink to be circulated so as to prevent the ink from flowing out from the space to the pump communication port, wherein, in the space forming unit, an ink supply port to which ink is supplied from a main tank included in the inkjet printer and a supply flow path serving as a flow path extending from the ink supply port to the ink storage chamber are formed, the supply flow path communicates with the ink storage chamber on a lower side of a lower limit of an ink liquid level set in the ink storage chamber in a vertical direction, in a state in which the ink is stored, the ink storage chamber is divided into a liquid phase portion and a gas phase portion with the ink liquid level as a boundary, the gas phase portion communicates with the pump communication port and at least the gas phase portion is communicated with a negative-pressure adjusting unit via the liquid-proof ventilation filter.

* * * * *